US005975055A

United States Patent [19]

Matsuda et al.

[11] Patent Number: 5,975,055

[45] **Date of Patent: *Nov. 2, 1999**

[54] ENGINE FOR MODELS

[75] Inventors: Norio Matsuda; Kazuyuki Tanaka, both of Mobara, Japan

[73] Assignee: Futaba Denshi Kogyo K.K., Mobara, Japan

[ * ] Notice: This patent is subject to a terminal disclaimer.

[21] Appl. No.: 08/898,956

[22] Filed: Jul. 23, 1997

[30] Foreign Application Priority Data

Jul. 23, 1996 [JP] Japan ..... 8-193464

[51] Int. Cl.[6] ..... F02M 23/00

[52] U.S. Cl. ..... 123/472; 123/DIG. 3; 123/531

[58] Field of Search ..... 123/472, 531, 123/676, DIG. 3, 533, 535, 498, 585

[56] References Cited

U.S. PATENT DOCUMENTS

| | | | |
|---|---|---|---|
| 5,080,079 | 1/1992 | Yoshida et al. | 123/531 |
| 5,211,682 | 5/1993 | Kadowaki et al. | 123/531 |
| 5,483,944 | 1/1996 | Leighton et al. | 123/531 |
| 5,488,933 | 2/1996 | Pham | 123/531 |
| 5,829,415 | 11/1998 | Matsuda | 123/531 |
| 5,832,882 | 11/1998 | Matsuda | 123/73 R |

*Primary Examiner*—Willis R. Wolfe
*Assistant Examiner*—Hieu T. Vo
*Attorney, Agent, or Firm*—Oblon, Spivak, McClelland, Maier & Neustadt, P.C.

[57] ABSTRACT

Air pressure which is proportional to the rotation speed of an engine is generated in a crank chamber 2 during operation. The crank chamber 2 is communicated to a fuel tank 10 having sealed structure with interposition of a check valve 25. Air pressure which is proportional to the rotation speed of the engine is applied to fuel in the fuel tank 10. The fuel tank 10 is communicated to the fuel injection system 30. The fuel injection system 30 opens its injection orifice only when power is supplied to a solenoid coil and injects supplied fuel into a combustion chamber. Because air pressure which is proportional to the rotation speed of the engine is applied to fuel, through each fuel injection time is constant, fuel which is proportional to the rotation speed can be injected. In particular, a shorter injection time is sufficient for high rotation speed operation in comparison with conventional fuel injection time, thereby power consumption of the fuel injection system 30 is reduced. Fuel injection rate is stabilized and the rotation stability at high speed is improved. This invention provides an engine for models in which power consumption of the electronic controlled fuel injection system is reduced and fuel is supplied adequately to the rotation speed.

7 Claims, 6 Drawing Sheets

ENGINE FOR MODELS

BACKGROUND OF THE INVENTION

1. Field of the Invention

This invention relates to an engine for models having an electronic controlled fuel injection system.

2. Description of Related Art

FIG. 6 shows the structure of a conventional four-cycle glow engine which has been known as an engine for models. Exhaust gas discharged from an exhaust muffler 101 of the engine 100 is partially guided into a fuel tank 102 in order to pressurize fuel in the fuel tank 102. Fuel which is pressurized at an approximately constant pressure by means of exhaust gas is sent to a needle valve 103, and supplied to the engine 100.

According to the engine for models described herein above, engine operation under low rotation speed such as idling operation is unstable, and when the engine is accelerated rapidly from the low rotation condition, a lot of air is fed in the valve body, but the supply of fuel can not follow the supply of air, and the balance of air-fuel ratio is unbalanced. The rotation of the engine increases not smoothly and increases slowly, and can be stopped in the bad case. As a whole, the response is not good, the transition from the low rotation speed to high rotation speed or the higher rotation speed to low rotation speed requires a long time, it is a disadvantage of the conventional engines.

The inventors of the present invention proposed an engine to solve the above-mentioned problem in which a constant pressure was applied to fuel in a fuel tank, and the pressurized fuel was injected into a combustion chamber using an electronic controlled fuel injection system. The fuel injection system used for the engine for models comprises a box to which pressurized fuel is fed, a coil accommodated in the box, and a valve disposed movably in the coil for closing a fuel injection orifice with pressing force of a forcing means. A current supply to the coil of the fuel injection system actuates the valve body to move in the opposite direction against the pressing force, and the closed fuel injection orifice is opened to inject fuel stored in the box into the outside.

In the above-mentioned engine for models proposed by the inventors of the present invention, fuel consumption per one cycle is different depending on the rotation speed, it is required to inject more fuel into combustion chambers in order to increase the rotation speed. In detail, as shown in FIG. 7, the rotation speed of the engine is proportional to the fuel injection time, for example, the fuel injection time during low speed operation such as 2000 rpm is assumed to be 1, then the fuel injection time during high speed operation such as 8000 to 10000 rpm range is about 2.

In the above-mentioned engine for models proposed by the inventors of the present invention, because the pressure applied to fuel is constant, it is required to extend a single fuel injection time in order to increase the fuel supply that is injected with a single injection. Therefore, the current supply time supplied to the coil of the fuel injection system is extended with increasing in rotation speed, and the extended current supply time results in the increased power consumption, this is a problem. Further, in the method that the fuel supply is controlled by controlling the injection time for injecting pressurized fuel at a constant pressure, the injection time can be longer than the time of one cycle for high speed rotation, in such high rotation speed operation, the fuel supply can not be controlled, it is another problem.

It is the object of the present invention to provide an engine for models with low power consumption of an electronic controlled fuel injection system, which is capable of supplying fuel adequately to the operated rotation speed and capable of being operated stably in wide rotation speed range.

SUMMARY OF THE INVENTION

The present invention has been made in view of the foregoing disadvantages of the prior art.

The engine for models according to the present invention is provided with a sealed fuel tank, an air pressure supplying means for supplying air pressure which increases with increasing in the rotation speed into the fuel tank, and a fuel injection system for injecting fuel introduced from the fuel tank into a combustion chamber with a substantially constant injection time regardless of rotation speed.

The engine for models according to the present invention is provided with a controller for controlling the fuel injection system so as to inject fuel with substantially the same constant injection time in spite of varying rotation speed.

The engine for models according to the present invention the air pressure supplying means which comprises a crank chamber where in-chamber pressure increases in proportion to the rotation speed.

The engine for models according to the present invention is provided with the air pressure supplying means which comprises a pressurizing means for supplying air pressure which is proportional to the rotation speed detected by a detection means into the fuel tank.

The engine for models according to the present invention is provided with a check valve between the air pressure supplying means and the fuel tank.

The engine for models according to the present invention is provided with the fuel injection system which includes a coil, a valve body which is moved by supplying a current to the coil, and a fuel injection orifice which is opened-closed by moving the valve body.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an engine for models according to the present invention will be described hereinafter with reference to FIG. 1 to FIG. 5.

Figure 1:
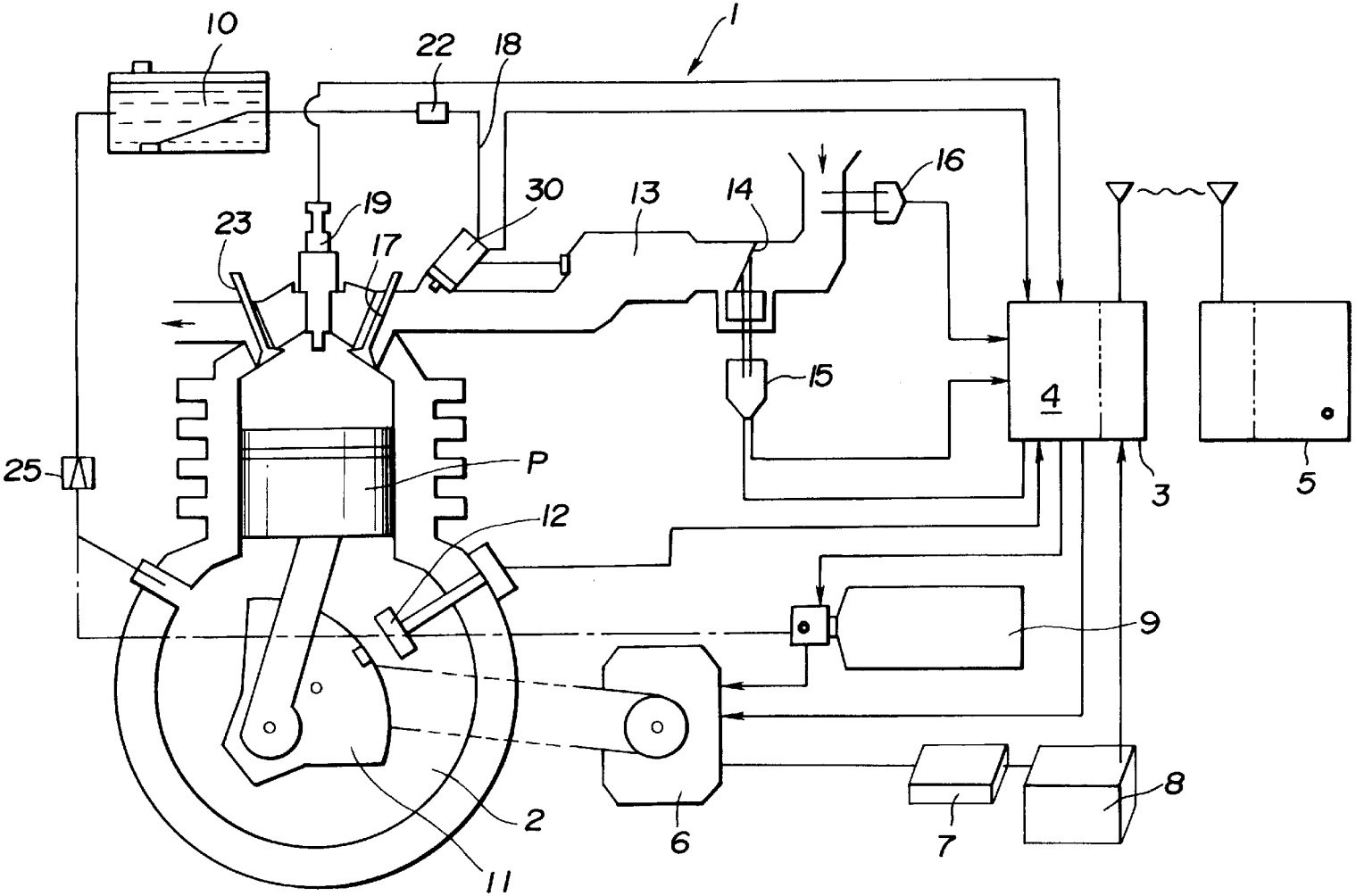
FIG. 1 is a schematic structural diagram of the first embodiment of the present invention.

The first embodiment of the present invention will be described hereinafter in detail with reference to FIG. 1 to FIG. 4. This embodiment relates to an engine for models provided with an electronic controlled fuel injection system. The engine 1 for models of this embodiment (refer to as engine 1 hereinafter) is to be mounted on radio control model planes. The engine shown in FIG. 1 is a four-cycle engine, methyl alcohol base fuel containing lubricating oil and ignition additive such as nitromethane is used. The volume of a combustion chamber is 1 to 30 cc.

Figure 3:
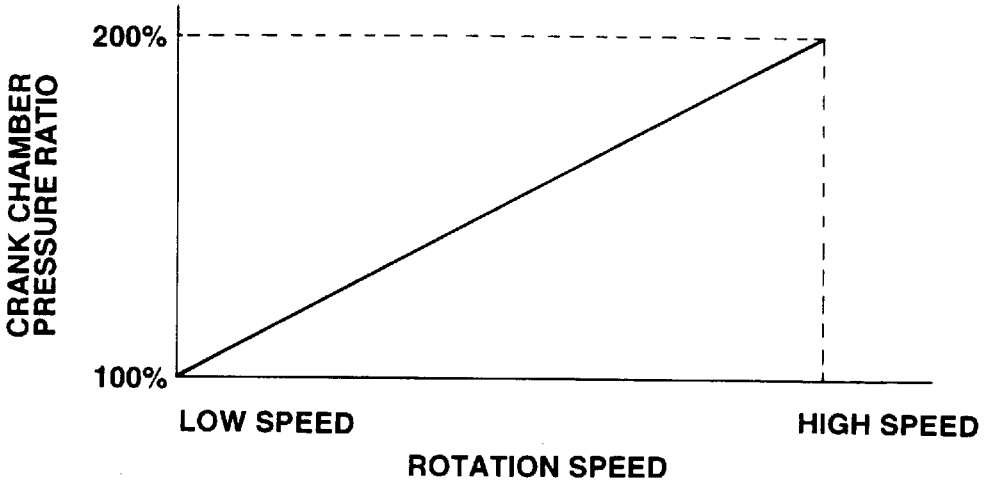
FIG. 3 is a graph for describing the relation between the rotation speed and the crank chamber pressure percentage.

The air pressure in the crank chamber 2 increases with increasing in the rotation speed of the engine during operation. As shown in FIG. 3, for example, the crank chamber pressure during low speed operation such as 2000 rpm (idling operation) is assumed to be 100%, then the average crank chamber pressure during high speed operation such as 8000 to 10000 rpm range (full high operation) is 200%. Though the generated pressure is different depending on the displacement of the engine, the above-mentioned percentage of pressure change in the crank chamber is almost the same regardless of the displacement of the engine. For example, the average crank chamber pressure of an engine with a displacement of about 15 cc is 15 kPa for low speed operation (idling operation) and 30 kPa for high speed operation (full high operation).

The engine 1 is controlled by means of the controller 4 of a receiver 3 mounted on the radio control model plane. An operator operates a transmitter 5, the receiver 3 receives radio wave transmitted from the transmitter 5, and the controller 4 of the receiver 3 controls components of the model plane including the engine 1.

The engine 1 shown in FIG. 1 starts with aid of the starter 6. The starter 6 is driven by power supplied from a battery 8 through a rectifier 7 or by pressurized air supplied from a pressurizing means which is an air supply means.

A rotational position sensor 12 is provided as a detection means for detecting the rotational position of the crank 11, the output signal from the rotational position sensor 12 is sent to the controller 4 of the radio control receiver 3. The driving cycle of the engine 1 and the rotation speed of the engine 1 are detected from the output signal of the rotational position sensor 12, the controller 4 controls the engine 1, for example, controls the timing of fuel injection based on the detection result.

An intake manifold 13 of the engine 1 has a throttle valve 14 for controlling intake air. The opening of the throttle valve 14 is controlled by a driving means 15. An intake air-temperature sensor 16 is provided on the air inlet of the intake manifold, signals from these sensors are supplied to the controller 4 of the radio control receiver 3 and utilized for controlling the engine 1.

The engine 1 has a fuel tank 10 having sealed structure. Air pressure which increases with increasing in the engine rotation speed is applied to fuel stored in the fuel tank 10. As an air pressure supplying means for supplying such air pressure to the fuel tank 10, the above-mentioned air pressure generated in the crank chamber 2 is used in this embodiment. In detail, the crank chamber 2 is communicated to the fuel tank 10, and a check valve 25 is provided between the crank chamber 2 and the fuel tank 10. Therefore, the positive air pressure is supplied to the fuel tank 10 out of the air pressure generated in the crank chamber 2. The air pressure generated in the crank chamber 10 increases with increasing in the engine rotation speed, therefore the air pressure which is proportional to the rotation speed of the engine is applied to fuel in the fuel tank 10. The sealed structure of the fuel tank 10 in this embodiment means air tight structure of such extent that the air pressure supplied from the crank chamber 2 remains effectively in the internal.

A fuel injection system 30 is disposed near the intake valve 17 of the intake manifold 13. The fuel injection system 30 is communicated to the fuel tank 10 with interposition of a filter 22. Pressurized fuel sent from the fuel tank 20 is supplied to the fuel injection system 30 through the filter 22.

The internal of the crank chamber 2 is communicated to the fuel injection system 30 with interposition of the check valve 25, and the positive pressure is supplied to the fuel injection system 30 out of the air pressure generated in the crank chamber 2 due to the engine operation.

The air pressure generated in the crank chamber 2 is used to pressurize fuel in the fuel tank 10 in this embodiment, but air which is conditioned at a suitable pressure may be supplied from the pressurizing means 9 to the fuel tank 10 as shown in FIG. 1 with a dashed line. In this case, the rotation speed of the engine 1 is detected by means of the rotation sensor 12, and the pressurizing means 9 is adjusted so that the air pressure which is proportional to the rotation speed is applied to the fuel tank 10. The above-mentioned control is performed by the controller 4.

Figure 2:
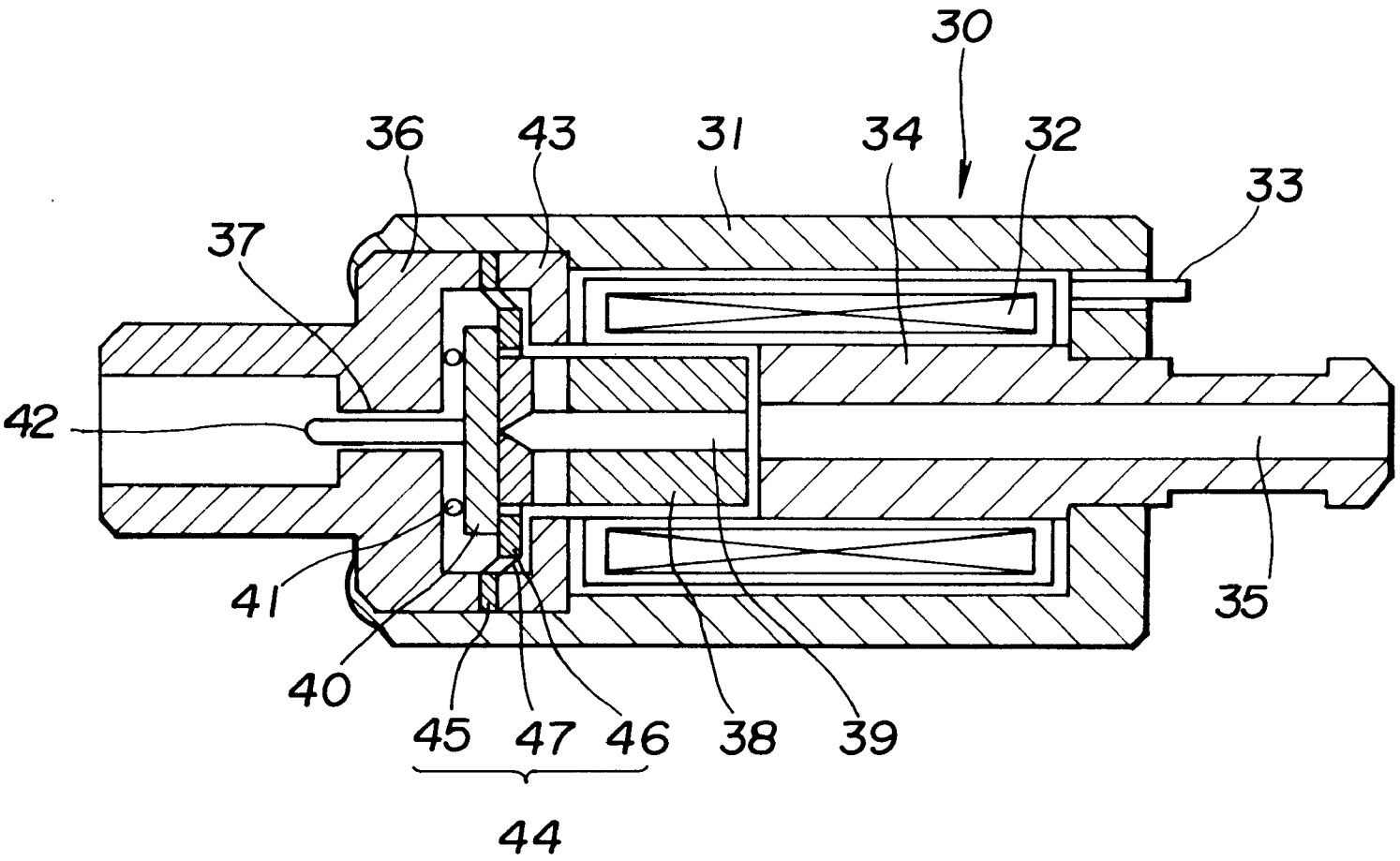
FIG. 2 is a cross-sectional view of a fuel injection system of the first embodiment of the present invention.

Next, the structure of the above-mentioned fuel injection system 30 is described. As shown in FIG. 2, the fuel injection system 30 is provided with an approximately cylindrical box 31. In the box 31, a solenoid coil is accommodated. A power terminal 33 for supplying power to the solenoid coil 32 is projected outside the box 31 through the box 31. A magnetic core 34 is inserted into the solenoid coil 32. A fuel supply passage 35 is formed through the axis of the magnetic core 34. The magnetic core 34 is projected outside the box beyond the base end of the box 31, and a portion of the magnetic core 34 outside the box 31 is communicated to the fuel supply conduit 18 guided from the fuel tank 20.

A valve box 36 is provided on the end of the box 31. A fuel injection orifice 37 is formed on the end of the valve box 36. In the box 31, an approximately cylindrical valve body 38 is inserted movably in the solenoid coil 32 adjacent to the magnetic core 34. The valve body 38 is provided with a flow passage 39 communicated to the fuel supply passage 35. A flange 40 is formed on the end of the valve body 38. A ring contact projection 41 for contact with the inside surface of the valve box 36 is provided on the periphery of the front face of the flange 40. A needle 42 is fixed at the center of the front face of the flange 40, and the needle 42 is inserted movably into the fuel injection orifice 37 of the valve body 38.

A plate spring 44 which is a pressing means for pressing the valve body 38 toward the fuel injection orifice 37 is provided between a fixing member 43 of the solenoid coil 32 and the valve box 36. The plate spring 44 comprises an outside ring fixing portion 45, inside ring moving portion 46, and connection arm 47 which connects elastically both portions. The fixing portion 45 is fixed between the fixing member 43 of the solenoid coil 32 and the valve box 36, and the moving portion 46 is fixed to the flange 40 of the valve body 38.

While power is not supplied to the solenoid coil 32, the valve body 38 is pressed toward the fuel injection orifice 37 by the pressing force of the plate spring 44, the contact projection 41 of the flange 40 is brought into contact with the inside surface of the valve body 36, and the fuel injection orifice 37 is closed. When power is supplied to the solenoid coil 32, the solenoid coil 32 attracts and moves magnetically the valve body 38 toward the magnetic core 34 against the pressing force of the plate spring 44. A space is formed between the flange 40 of the valve body 38 and the valve box 36 as the result of such movement. Fuel which is pressurized at a certain pressure in the box 31 is injected from the fuel injection orifice 37 to the outside of the box 31.

Fuel injected from the fuel injection system 30 is mixed with air which is taken in depending on the opening of the throttle valve 14, and fed into a cylinder from an intake valve 17 which is opened at a predetermined timing. A glow plug 19 ignites the air-fuel mixture at a predetermined timing to start combustion. Burnt gas is exhausted outside the cylinder from an exhaust valve 23 which is opened at a predetermined timing.

Next, operation of the embodiment is described.

The engine 1 for models of the embodiment is a four-cycle engine, the operation is continued by repeating suction stroke, compression stroke, explosion stroke, and exhaust stroke. The air pressure in the crank chamber 2 fluctuates due to reciprocating motion of the piston P during operation. Only the positive pressure is utilized selectively with the check valve out of the pulsatory air pressure supplied from the crank chamber 2, and the positive pressure with suppressed pressure fluctuation is supplied to the fuel tank 10. As shown in FIG. 3, the air pressure generated in the crank chamber 2 during operation increases with increasing in the rotation speed of the engine.

The fuel injection system 30 is driven with a predetermined timing synchronously with engine stroke to inject fuel. The controller 4 controls the operation of the fuel injection system 30. The timing of fuel injection is determined by the rotational position sensor 12 for detecting the position of the crank 11. When the rotational position sensor 12 detects the position of the crank 11 and the starting of opening motion of the intake valve 17, the controller 4 supplies power to the solenoid coil 32 of the fuel injection system 30 and starts to inject fuel in response to the detection signal. Because a four-cycle engine rotates twice in one cycle, the injection timing may be detected using a poppet cam shaft (not shown in the drawing).

Power supply to the solenoid coil 32 causes attraction of the valve body 38 toward the magnetic core 34 against elastic force of the plate spring 44, a space is formed between the seal surface 53 of the valve body 38 and conical surface 54 of the valve box 36. Fuel which is pressurized in the fuel tank 10 at a pressure corresponding to the rotation speed of the engine and supplied to the box 31 is injected with pressurized air to the outside of the box 31 from the fuel injection orifice 37 at the fuel injection timing.

Because the flow speed of pressurized air injected from the fuel injection system 30 is fast when fuel is injected, fuel receives action of air so that fuel is sucked out from the box 31 outside. Therefore, pressurized fuel supplied to the fuel injection system 30 is mixed with compressed air introduced in the box 31 to some extent, thereafter the mixture is injected from the fuel injection orifice 37 in the form of mist, and thus the combustion efficiency of the engine 1 is improved.

The fuel injected from the fuel injection system 30 is mixed with air which is taken in depending on the opening of the throttle valve 14, and introduced into the cylinder from the intake valve 17 which is opened at the predetermined timing. The glow plug 19 ignites air-fuel mixture at a predetermined timing to start combustion. Burnt gas is discharged from the cylinder to the outside through the exhaust valve 23 which is opened at a predetermined timing.

Figure 4:
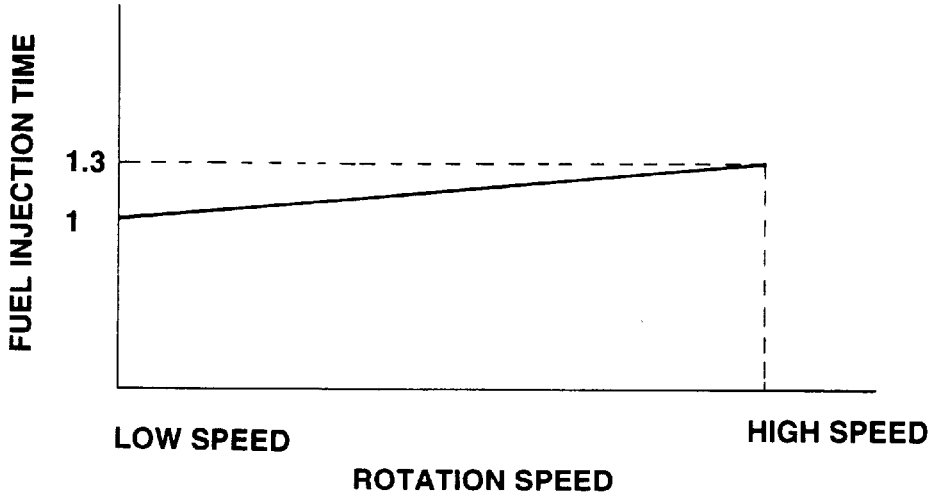
FIG. 4 is a graph for describing the relation between the rotation speed and the fuel injection time in the first embodiment of the present invention.

The continuous injection time of fuel for a single fuel injection operation, namely the current supply time to the solenoid coil 32 for a single fuel injection operation, is approximately constant regardless of rotation speed of the engine as shown in FIG. 4. In detail, assuming that the fuel injection time is 1 at low rotation speed, the fuel injection time at high rotation speed is approximately 1.3.

Increased rotation speed requires increased fuel supply to the engine. If the fuel pressure is constant, then the fuel injection time should be longer in order to supply much more fuel. In this embodiment, a structure that applies higher air pressure to fuel in the fuel tank 10 in proportion to the rotation speed of the engine is employed, fuel is injected in an amount proportional to rotation speed in spite of approximately constant fuel injection time. In other words, required amount of fuel can be supplied at high rotation speed operation in an injection time not so different from that at low rotation speed operation. Thereby power consumption of the fuel injection system 30 is reduced in comparison with conventional fuel injection systems. The fuel injection rate is stable at high rotation speed, and the speed stability at high rotation is improved. Further, the response speed from low speed operation to high speed operation is improved. Rotational stability is improved.

The fuel injection time may be corrected using the opening of the throttle valve 14, intake air at the air inlet of the intake manifold 13, and signal from the temperature sensor 16.

Figure 5:
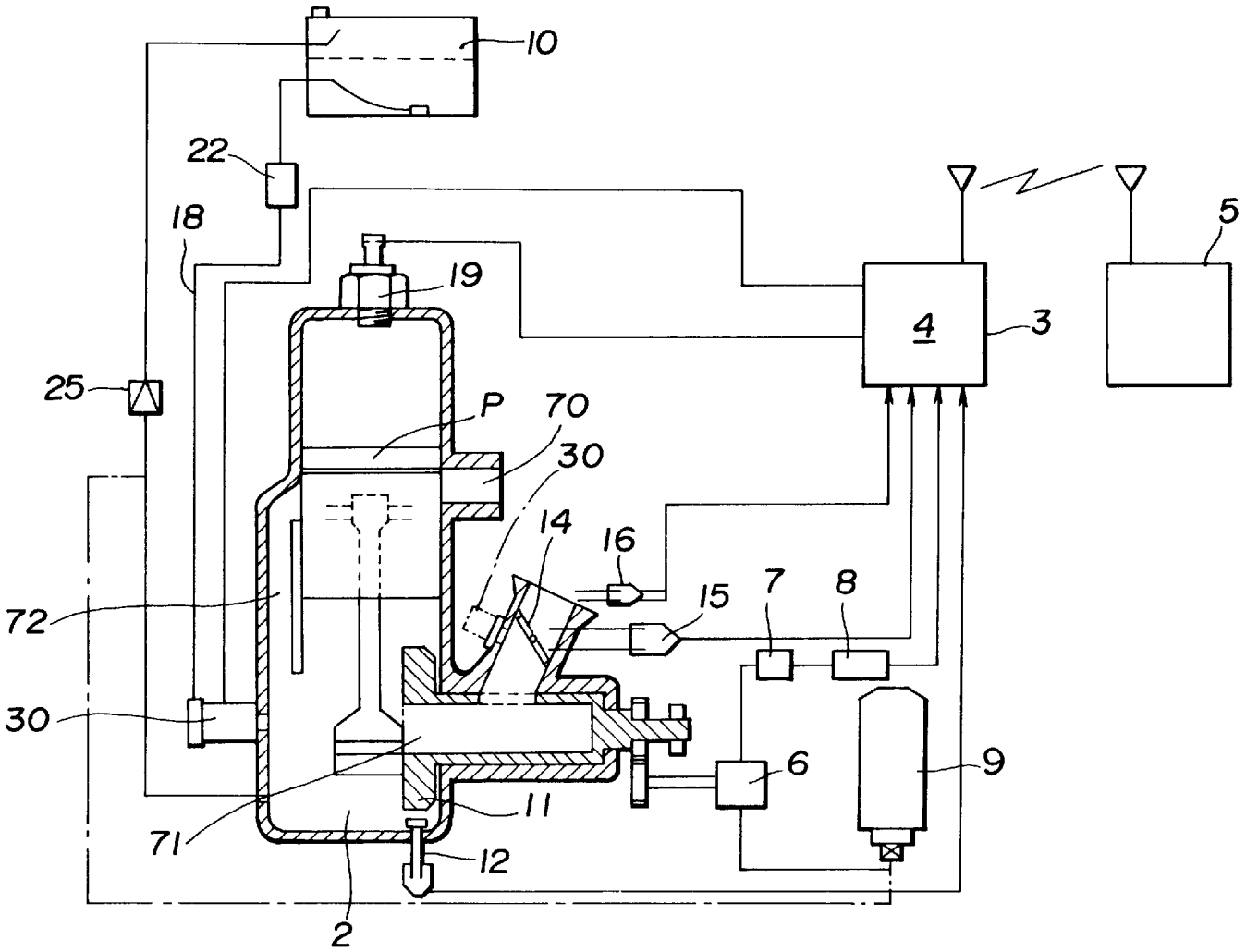
FIG. 5 is a schematic structural diagram of the second embodiment of the present invention.
Figure 6:
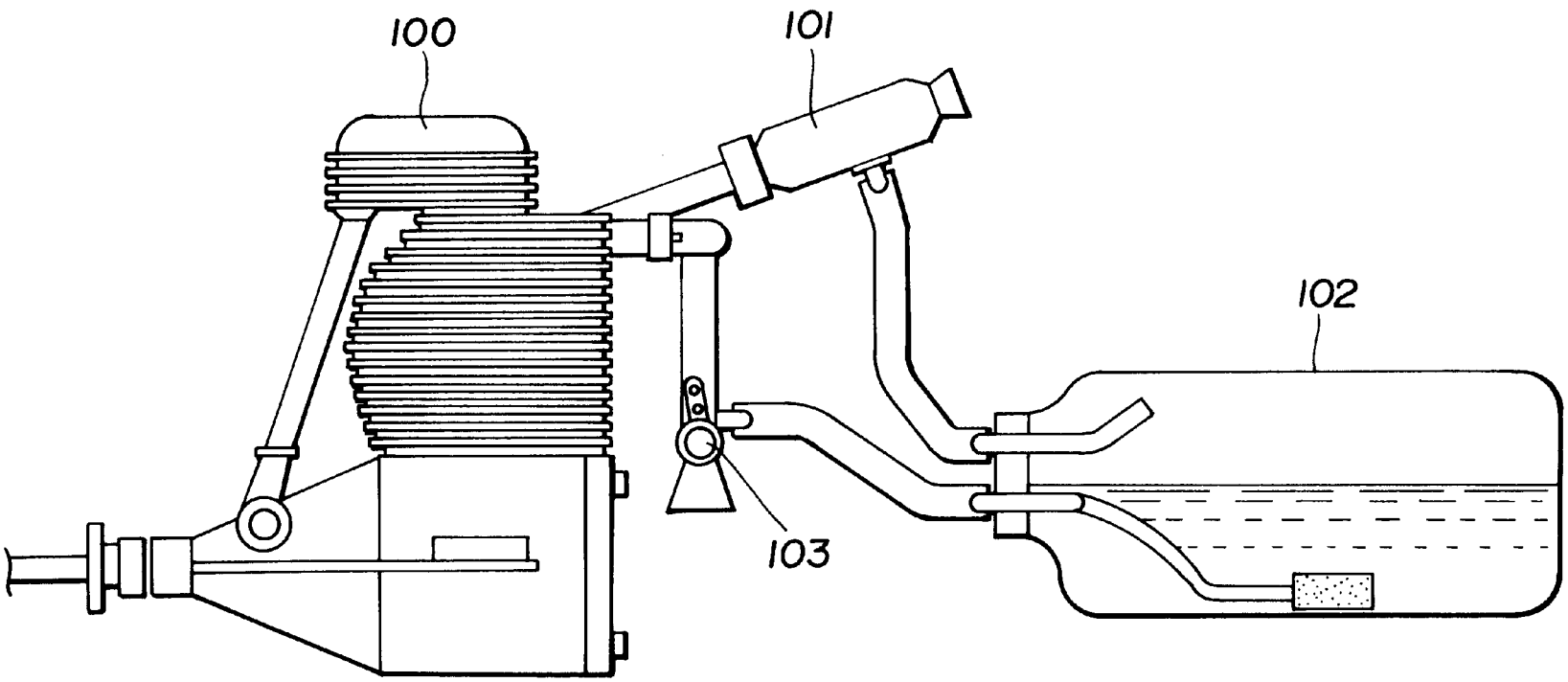
FIG. 6 is a partially cross-sectional side view of a conventional engine for models.
Figure 7:
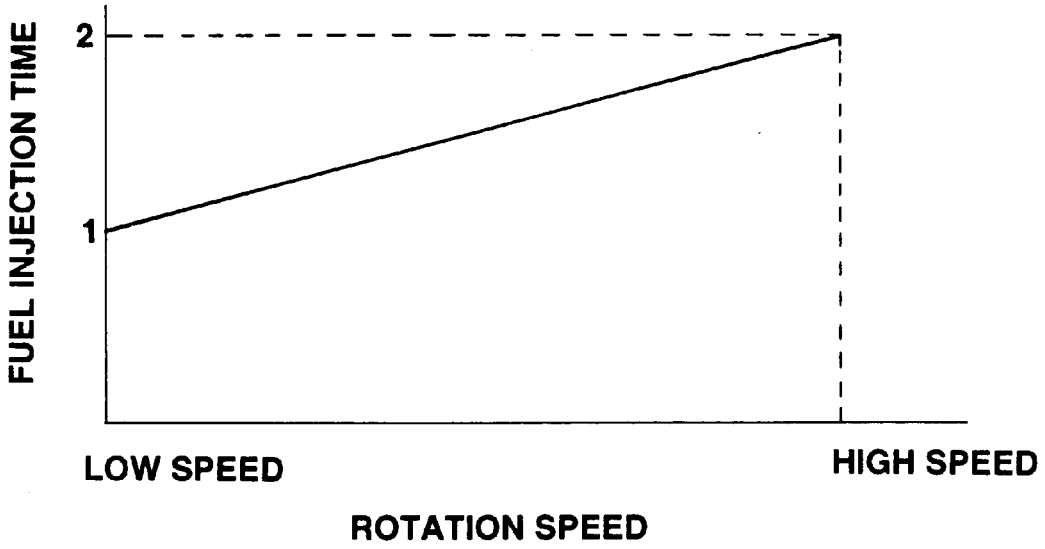
FIG. 7 is a graph for describing the relation between the rotation speed and the fuel injection time in a conventional engine for models.

The second embodiment of the present invention is described with reference to FIG. 5. This embodiment involves a two-cycle engine for models having an electronic control fuel injection system. A two-cycle engine has neither inlet valve nor exhaust valve unlike a four-cycle engine, exhaust vent 70, intake port 71, and scavenging port 72 are formed on a cylinder directly as shown in FIG. 5, and a piston P itself operates opening-closing of these ports. The same functional components in FIG. 5 as shown in FIG. 1 are given the same characters as shown in FIG. 1, and detailed description is omitted. The fuel injection system of this embodiment injects fuel into a crank chamber, but alternately may inject fuel into the intake manifold as shown with an imaginary line.

Also in the two-cycle engine for models, increased rotation speed of the engine results in increased average pressure in the crank chamber like a four-cycle engine as described herein above. The increased rotation speed of the engine requires increased fuel consumption per one cycle, therefore, the application of pressure in the crank chamber to fuel in the fuel tank leads to shorter fuel injection time at high rotation operation in comparison with conventional engines.

In the description of the respective embodiments hereinbefore, the fuel injection system 30 is described as a fuel injection system to be mounted on radio controlled model planes, however, the model plane is not limited to radio controlled model planes for hobby but also includes various movable bodies used in industrial fields on which a relatively small engine is mounted, in detail, includes model automobiles and model boats.

In the respective embodiments of engines for models, a fuel tank 10 having sealed structure is communicated to a crank chamber with interposition of a check valve 25, only the positive pressure out of pulsatory pressure generated in the crank chamber 2 is applied to the fuel tank 10, thereby air pressure proportional to the rotation speed is applied to fuel. Accordingly, a regulator for regulating air pressure is needless, the fuel injection system can be manufactured at low cost.

In the engine for models of the present invention, air pressure generated in the crank chamber which is proportional to the rotation speed of the engine is applied to the fuel tank having sealed structure. Therefore, the air pressure which is proportional to the rotation speed of the engine is applied to fuel, thus the following effects can be obtained.

(1) Because fuel pressure increases with increasing in the rotation speed, the fuel injection time at low rotation speed is sufficient for supplying fuel required for high rotation speed operation when much more fuel is consumed, thereby power consumption of the fuel injection system is reduced, and the life of a power source battery is extended.

(2) In particular, fuel injection rate is stable during high speed operation, and high speed stability is improved.

(3) Response speed from low speed operation to high speed operation is improved.

(4) Rotation stability is improved.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An engine for models comprising a sealed fuel tank, an air pressure supplying means for supplying positive air pressure, which increases with increasing rotation speed of the engine, to said fuel tank, and a fuel injection system for injecting fuel pressurized by said positive air pressure from said fuel tank into a combustion chamber.

2. The engine for models as claimed in claim 1, wherein said fuel injection system includes a solenoid operated valve for discharging the pressurized fuel into said combustion chamber, and said fuel injection system being controlled by a controller so as to inject fuel with substantially the same constant injection time regardless of varying rotation speed.

3. The engine for models as claimed in claim 1, wherein said air pressure supplying means is a crank chamber where in-chamber pressure increases in proportion to the rotation speed.

4. The engine for models as claimed in claim 1, wherein said air pressure supplying means is a pressurizing means for supplying air pressure which is proportional to the rotation speed detected by a detection means into said fuel tank.

5. The engine for models as claimed in claim 1, wherein a check valve is provided between said air pressure supplying means and said fuel tank.

6. The engine for models as claimed in claim 1, wherein said fuel injection system is provided with a coil, a valve body which is moved by supplying a current to said coil, and a fuel injection orifice which is opened-closed by moving said valve body.

7. An engine for radio controlled models comprising:

a sealed fuel tank;

a cylinder having a combustion chamber;

a piston mounted for reciprocal motion within said cylinder;

a crankcase;

a crankshaft supported for rotation within said crankcase in response to the reciprocation of said piston;

said crankcase being communicated with said sealed fuel tank by means of a check valve for supplying positive air pressure generated within said crankcase in response to the rotation of said crankshaft wherein said air pressure being increased with increasing rotation speed of the engine; and a fuel injection system for injecting fuel pressurized by said positive air pressure from said fuel tank into said combustion chamber.

* * * * *